United States Patent [19]

Moeller

[11] 3,986,314

[45] Oct. 19, 1976

[54] CEILING ASSEMBLY WITH REMOVABLE PARTITION WALLS

[76] Inventor: Wolfgang W. Moeller, 4 Glen Cove Drive, Glen Head, N.Y. 11545

[22] Filed: Dec. 23, 1974

[21] Appl. No.: 535,864

[52] U.S. Cl. ..... 52/484; 52/243; 52/241; 52/715

[51] Int. Cl.[2] ..... E04B 5/52

[58] Field of Search ..... 52/484, 489, 241, 243, 52/714, 715, 712, 496; 403/406; 24/73 B, 201 A

[56] References Cited

UNITED STATES PATENTS

| | | | |
|---|---|---|---|
| 2,082,314 | 6/1937 | Venzie | 52/489 |
| 3,395,504 | 8/1968 | Zwickert | 52/241 |
| 3,596,425 | 8/1971 | Kodarus | 52/241 |
| 3,608,159 | 9/1971 | Brucker | 24/201 A |
| 3,608,266 | 9/1971 | Satkin | 52/241 |
| 3,638,387 | 2/1972 | Lickliter | 52/241 |
| 3,708,932 | 1/1973 | Bailey | 52/484 |
| 3,732,660 | 5/1973 | Byssing | 52/489 |
| 3,753,325 | 8/1973 | Stanley | 52/489 |
| 3,861,103 | 1/1975 | Rasmassen | 52/241 |
| 3,897,163 | 7/1975 | Holmes | 403/406 |

FOREIGN PATENTS OR APPLICATIONS

| | | | |
|---|---|---|---|
| 15,005 | 6/1912 | United Kingdom | 85/5 P |
| 941,028 | 11/1963 | United Kingdom | 52/484 |

*Primary Examiner*—Price C. Faw, Jr.
*Assistant Examiner*—Henry Raduazo
*Attorney, Agent, or Firm*—Burgess, Dinklage & Sprung

[57] ABSTRACT

A suspended ceiling tile assembly is disclosed of the type having main runners interconnected by cross members defining a grid assembly where the grid assembly has horizontal ledges engaged by ceiling tile, the improvement being in that there is at least one slot in a main runner or in a cross member and a vertical support for supporting a removable wall partition which vertical support member extends from the grid assembly at the slot, the vertical support member having a generally horizontal top member also having a slot therein, the slot of the generally horizontal top member and the slot of the main runner or cross section being in general registry with one another and separated by a gap, the main runner or cross member being interconnected with the horizontal member of the vertical support member by a clip which overlies a horizontal ledge of a main runner or cross member and underlies the horizontal member of the vertical support member, said clip defining the gap between the main runner or cross member and a vertical support member; the clip itself, an improved assembly for connecting interior wall partitions to a vertically running partition support and an entire system by which vertical partition walls can be assembled and disassembled to a ceiling tile assembly without damage to the ceiling tile, without damage to the partitions and without the use of expensive materials or equipment.

29 Claims, 14 Drawing Figures

CEILING ASSEMBLY WITH REMOVABLE PARTITION WALLS

BACKGROUND OF THE INVENTION

1. Field of the Invention

This invention relates to an entire system by which interior partition walls can be connected to a suspended ceiling tile assembly. More particularly, this invention relates to an improved ceiling tile assembly provided with means for connecting a vertical partition wall assembly thereto without requiring removal of any of the components of the ceiling tile assembly. This invention is further directed to an improved vertical partition support assembly providing for ready connection of a vertical partition wall. Still furthermore this invention is directed to improved partition walls which can readily be snapped into or otherwise engaged with a vertical partition support. Also provided by the invention are means for vertically supporting interior partition walls of the removable type and molding means for overlying any gaps existing at a structural floor or at the junction of a vertical partition and a ceiling tile assembly. Of particular interest is a novel clip member for joining a vertical support member to a ceiling tile assembly.

2. Discussion of the Prior Art

Suspended ceiling tiles of the type employed in commercial construction are known. Generally speaking, these assemblies comprise main runners interconnected by cross members. These ceiling tiles are suspended from the structural ceiling to provide an area between the structural ceiling and the suspended ceiling for the passage of air conditioning ducts and plumbing and electrical fixtures. It is desirable, however, that the suspended ceiling tile be constructed so that maximum access can be had to the physical components of the structure disposed in the zone between the suspended ceiling tile and the structural ceiling. It is also desirable, however, to provide means for the support of partition walls.

The suspended ceiling tile structures and the partition walls are not always compatible. Difficulties have heretofore been encountered in the construction of commercial buildings such as those found in major cities owing to the fact that means had to be provided for securing the partitions to the building structure. Difficulties have been encountered resulting in a lack of total acceptance of removable partition walls.

It is also known that even in those buildings having removable partition walls difficulties are encountered in the removal of the walls and the reassembly of the partition walls elsewhere in the buildings. For instance, it is known that the ceiling tile assembly itself must be broken down somewhat to remove the supports for the vertical partitions. It is also known that this entire grid assembly must be disturbed at least to some extent in the assembly of a partition wall. It has, therefore, become desirable to provide a new system whereby partition walls can be interconnected with suspended ceiling tile assemblies such that when the partitions are connected to the ceiling tile the ceiling tiles need not be moved. It is also desirable to provide such a system wherein a partition wall can be disassembled from such a system without requiring removal of the ceiling tiles or without in any way interfering with an established suspended ceiling tile assembly. These and other objects will become apparent from the following description and claims.

SUMMARY OF THE INVENTION

The objects of the invention are provided in a suspended ceiling tile assembly wherein main runners and cross members intersect to define a grid assembly, said grid assembly having horizontal ledges engaged by ceiling tile, the improvement for attaching a vertical dependent member therefrom residing in that at least one slot is provided in a main runner or in a cross member, a vertical support member extends from said grid assembly at said slot, said vertical support member having a generally horizontal top member having a slot therein, the slot of said generally horizontal member and the slot of said main runner or cross member being in general registry with one another and separated by a gap, said main runner or cross member being interconnected with said horizontal member of said vertical cross member by a clip which overlies a horizontal ledge of the main runner or cross member and underlies said horizontal member, said clip thereby defining the gap between said main runner or cross member and said vertical support member.

In the assembly of the present invention a provision is made for disposing a vertical support member, generally in the form of an inverted U-shaped track along a seam of suspended ceiling tile in such a manner so as to abut the ceiling tile. This abutment does not, however, damage the ceiling tile. The connection of the inverted U-shaped vertical support member is accomplished through the use of a clip which protrudes through a slot of the inverted U-shaped vertical support member and a slot in a main runner or cross member. Engagement of the slot is such so as to define a gap between the lower surface of the main runner or cross member and the upper surface of the vertical support member which gap corresponds to the thickness which need be provided to accommodate the ceiling tile. The clip can have a number of alternate engaging means so that the appropriate engaging means can be selected for the thickness of ceiling tile present in the structure.

Also provided by the present invention is a further improvement for connecting a partition to this assembly. To this end there is attached to the vertical support member a vertical partition support which runs generally vertically from the vertical support member to a structural floor. This vertical partition support preferably has flanges extending from a cross member which flanges run generally parallel to the vertical support member. These flanges serve as a means for afixing the vertical partition thereto. The partition can be snapped into place by virtue of a resilient snap-in type member disposed linearly and vertically along a back surface of the partition. By applying pressure on the face of the partition, the clips being on the interior or back side of the partition disposed off the vertical edge thereof, the clips can be caused to depress inwardly and bear against the inside surface of the flange of the partition support whereby the partition support serves to hold the same against falling outwardly.

Means are also provided to hold the partition against downward movement said means comprising a partition resting device which can fit within one of several laterally running slots on the face of a vertical partition support. The invention also provides molding means disposed over the partition support and the partition resting means to obscure the mechanical interconnections.

BRIEF DESCRIPTION OF DRAWINGS

The invention can be more readily understood when reference is made to the accompanying drawings in which:

FIG. 8 also shows in exploded form the relative disposition of a partition resting member to the vertical partition support;

DESCRIPTION OF SPECIFIC EMBODIMENTS

Figure 1:
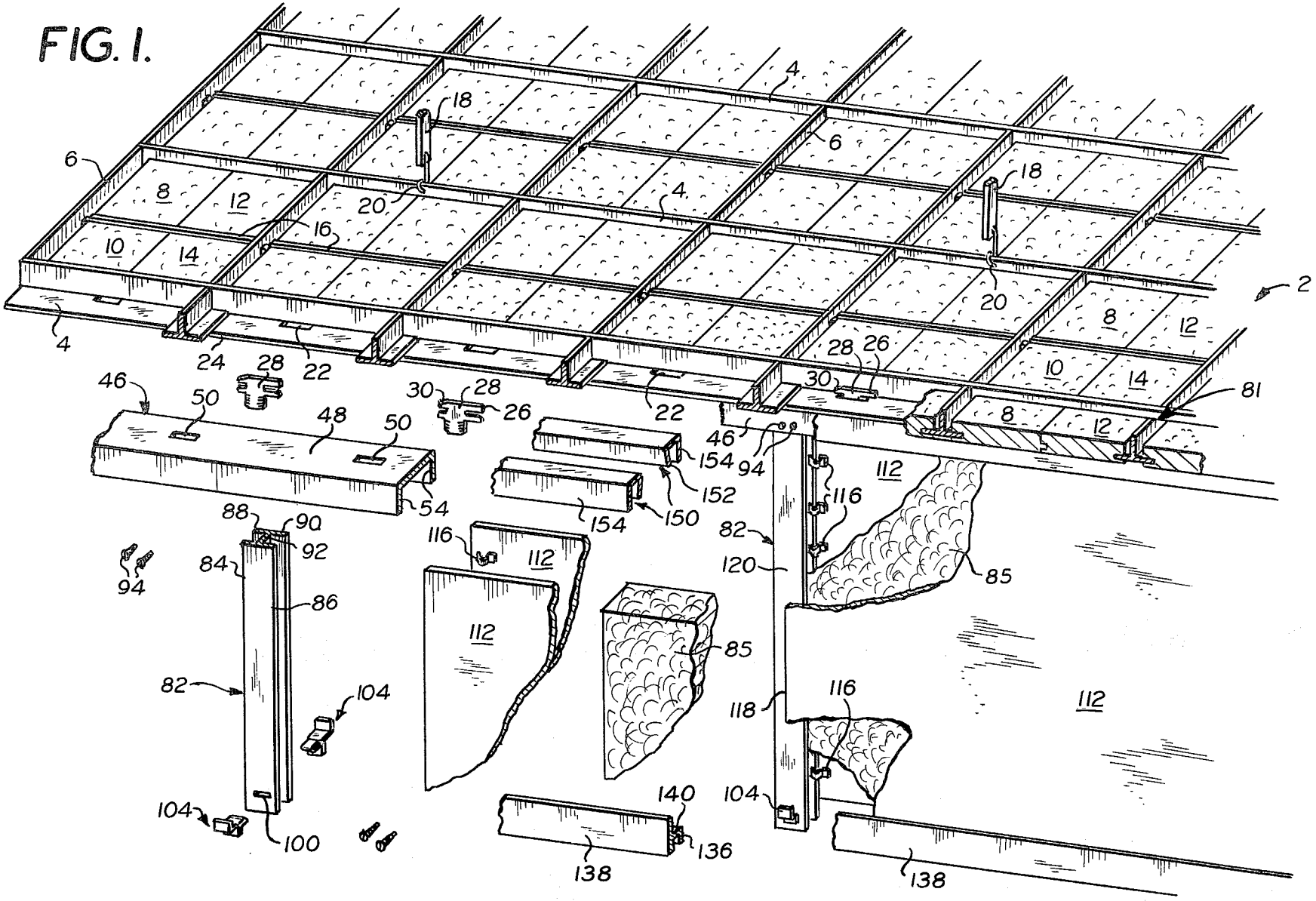
FIG. 1 is an exploded and schematic view of a ceiling tile assembly and partition assembly, according to the invention, which is in perspective view.

The invention can be more readily understood by referring to FIG. 1 which shows a suspended ceiling tile structure 2 having main runners 4 interconnected with cross members 6. Within the grid system defined by main runners 4 and cross members 6 there are a plurality of ceiling tiles 8, 10, 12 and 14 interconnected by a spline 16. This assembly can be in the manner of copending application Serial No. 535,863 filed concurrently herewith entitled "Ceiling Tile Assembly". According to this invention an L-shaped spline is provided having at either end thereof snap-in means disposed over a facing ledge of a cross-member or main runner. The vertical portion of the L-spline is generally inclined slightly towards the base and a slot is provided along the base slightly out of registry with the vertical member. A tool can pass through the seam between panels such as the seam between panels 10 and 14 on the one hand, and 8 and 12 on the other to engage the L-shaped spline and to effect its removal. The disclosure of said copending application Serial No. 535,863 is hereby incorporated herein by reference.

The main runners or cross members are connected to the structural ceiling by a strap 18 terminating in a hook 20 interengaging a cross member or main runner. According to the invention a cross member and/or main runner is provided with a slot 22. Generally speaking, the slot 22 has a rectangular shape and has a length of at least about one-half inch. Generally speaking, the length is between three-fourths of an inch aand 1.5 inch. The embodiment of FIG. 1 shows the slots 22 to be in the main runners 4. It should be understood, however, that it is preferred that there be slots in both the main runners and the cross members. This allows for the assembly of a partition wall in either direction.

Figure 2:
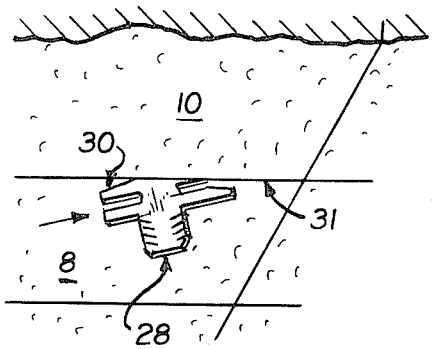
FIG. 2 is a side elevation enlarged in respect of FIG. 1 showing the insertion of a clip member through a slot on a main runner or cross member of a ceiling tile.

Through the horizontal ledge 24 of a main runner there is passed the long leg 26 of a clip 28 as seen in FIG. 2. Long leg 26 rests over the horizontal ledge 24 and engages the same. For this purpose it is desirable that the short leg 30 of the clip 28 be beveled at its upper side on the end thereof so that insertion of the clip into the slot does not damage the ceiling tile thereabove. As seen in FIG. 2 the entry of the clip 28 is accomplished by passing the same through the seam between ceiling tiles. This seam underlies the slot of a main runner or cross section. Thus to place the clip 28 over the horizontal ledge 24 of a main runner 4 all that an operator need do is to insert the clip through the seam and to work the same along until he finds a slot 22. The longer arm 26 will readily pass over the horizontal ledge of a main runner or cross member which will become disposed within the opening 34. This will permit the shorter arm 30 to be raised through the slot 22 thereby disposing both the longer arm and the shorter arm in the region above the horizontal ledge of the main runner or cross member. The clip is then moved in the opposite direction so that both the arms 26 and 30 rest upon the horizontal ledge. The net result is shown in FIG. 4.

Figure 4:
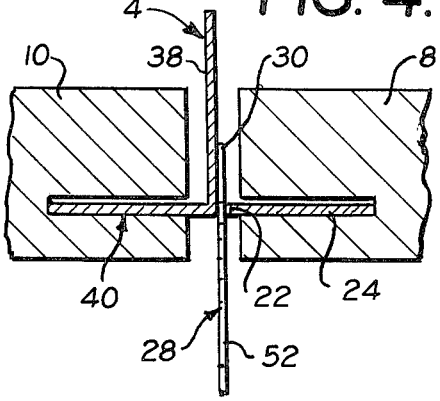
FIG. 4 is a sectional view showing the disposition of the clip of FIG. 3 through a slot in a main runner of a ceiling tile assembly.

In FIG. 4 there is shown a T-shaped main runner 4 having a vertical member 38 which interconnects a horizontal member 40. The clip 28 passes through the slot 22 in the horizontal ledge 24 and the shorter arm 30 is urged over the edge of the slot 22 to overlie the ledge 24. Obviously, clip 28 runs generally parallel to the vertical member 38. The disposition of shorter arm 30 and longer arm 26 over the horizontal ledge 24 is best shown in the perspective view of FIG. 1.

Figure 5:
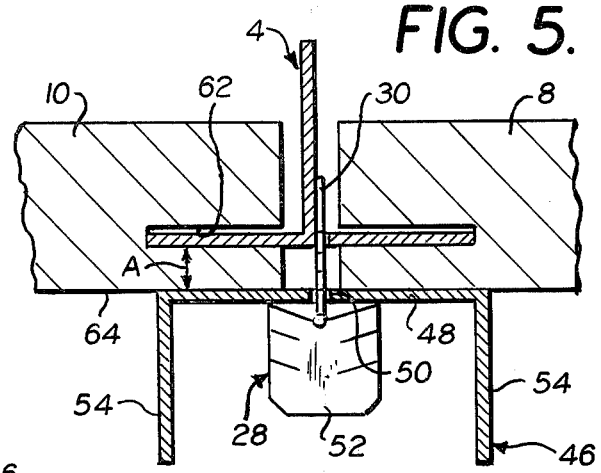
FIG. 5 is a view showing the manner by which the clip of FIG. 3 holds a vertical support member in abutment against ceiling tile, the vertical support member shown to have a generally inverted U-shape.

In the construction of a partition wall against a suspended ceiling tile the next step is to insert a vertical support member over clip 28. This is done employing a vertical support member such as vertical support member 46 which has a horizontal top member 48 having slots 50 therein. Obviously, the vertical support member 46 can have any length and is desirably multi-slotted inasmuch as the slots 50 should at various points be in registry with the slots 22 of the main runner or cross member. Conveniently, the vertical support member 46 can be slotted at regular intervals, e.g., every foot, with a slot 50 appropriately sized so as to be engagable with the slot 22 of the main runner or cross member. The connection of the vertical support 46 to the ceiling tile assembly by use of the clip is shown in FIG. 5. Here, there is shown the disposition of a generally inverted U-shaped vertical cross member which runs along a seam between suspended ceiling tile. The U-shaped cross member is inserted over the vertical tab 52 of the clip 28. This vertical tab is provided with engaging means. In FIG. 5 there is shown the abutment of the upper surface 48 of the vertical support member 46 with the pendent vertical sides 54 being connected to the top 48 such as to define an angle of about 90°C.

Once the vertical support is raised over the pendent tab 52 of clip 28 closure can be effected. In the embodiment of FIG. 5 there are a plurality of generally V-shaped engaging means 60 which lie in the same vertical plane as the tab 52. Any one of these V-shaped enclosure means can be turned, say, an angle of 90° so as to lie in a different vertical plane than the tab 52. By twisting or rotating a closure means 60 the ends of the V thereof will be in abutment with the lower side of the horizontal member 48 thereby urging horizontal member 48 against the ceiling tile disposed thereabove.

Figure 6:
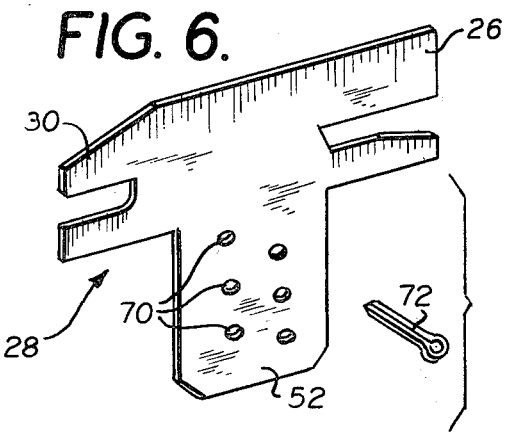
FIG. 6 is a view of an alternate embodiment of the clip, FIG. 6 differing from FIG. 3 in the means provided to secure the clip against the lower surface of the vertical support member.
Figure 7:
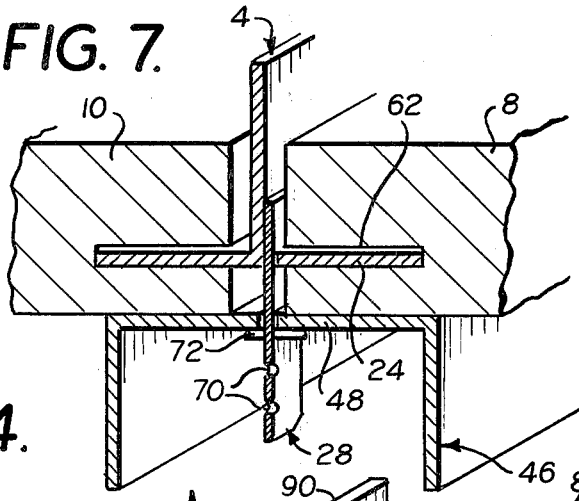
FIG. 7 is a view similar to FIG. 5 showing the manner by which the clip of FIG. 6 secures the inverted U-shaped vertical support member against the ceiling tile, this U being partially in perspective. This view also shows the manner by which one connects a vertical partition support to a vertical support member.

As shown in FIG. 5 there are a plurality of these V-shaped closure members. The purpose in providing a plurality of such members is to provide for various thicknesses of ceiling tile. Obviously, the dimension A between the curf 62 of a ceiling tile and the bottom face 64 of the tile will vary. Thus the distance between the horizontal ledge 24 of a cross member or main runner and the upper surface of horizontal member 48 will vary. Naturally, it is desirable to have a single clip 28 which is useful for all sizes of ceiling tile, i.e., useful in ceiling tile having various A dimensions. This is done by the simple embodiment of FIG. 3. In FIG. 5 the first or upward most rotatable member has been twisted 90° so as to be in abutment with the lower surface of the horizontal member 48. However, if the distance A were greater it would have been necessary to employ a V-shaped closure member therebeneath such as that one identified by reference numeral 60'. In FIGS. 6 and 7 an alternate embodiment is shown wherein a series of alternately spaced holes 70 are provided which can accommodate a horizontal securing pin 72 such as a cotter pin. The use of the clip of FIG. 6 is virtually identical as the clip of FIG. 3 except that the means for abutting the tab 52 against the lower surface of the horizontal member 48 are different, this being accomplished in the embodiment of FIGS. 6 or 7 by use of cotter pin 72. Referring to FIG. 7 cotter pin 72 passes through the appropriate hole 70 of tab 52 which hole depends upon the dimension A of the ceiling tile. In any event, there is no problem at all to securely abut the vertical support member against the tile without damaging the tile or the grid assembly.

Figure 8:
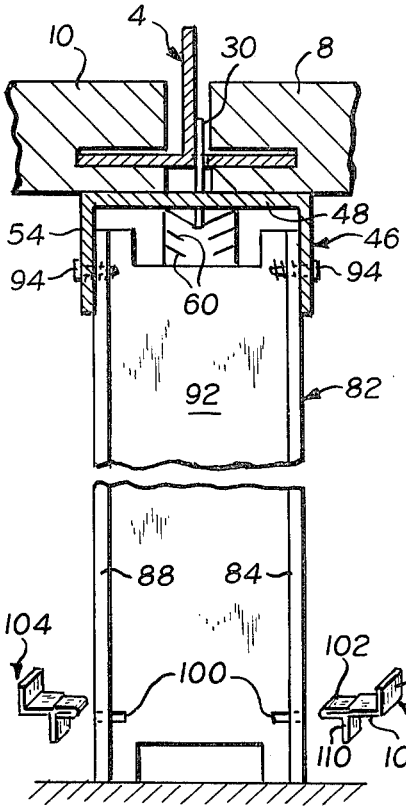
FIG. 8 is a view similar to FIG. 7, but not in perspective showing the disposition of a vertical partition support with respect to a vertical support member and the securement of the vertical partition support to the vertical support member.

In the construction of a partition wall the next step is to insert vertical partition supports within the vertical support member which runs track-like beneath a that the vertical support 46 would normally run the entire length of the partition to be erected. Thus if it were desired to erect a partition the entire length of the ceiling tile assembly shown in FIG. 1, there would normally be employed a vertical support member which would run the entire distance. It would be interconnected to the main runner or cross member at a plurality of points as it travels along the seam between ceiling tile. The seam between the ceiling tile is shown by reference numeral 81 in FIG. 1 wherein there is shown the disposition of the next course of tile on the other side of the partition. For the purpose of affixing the partition to the vertical support member there is employed a vertical partition support 82 which preferably has laterally running flanges 84 and 86 on one side thereof and opposed laterally running flanges 88 and 90 on the other side preferably interconnected by a cross member 92. Preferably, the vertical partition support has an H cross section. The vertical partition support is placed within the downwardly extending vertical legs 54 of the vertical support member and is secured thereto by use of self-tapping screws 94. This assembly is shown in FIG. 8. The vertical support member will extend to a structural floor therebeneath and, if desired, can be secured thereto.

Figure 9:
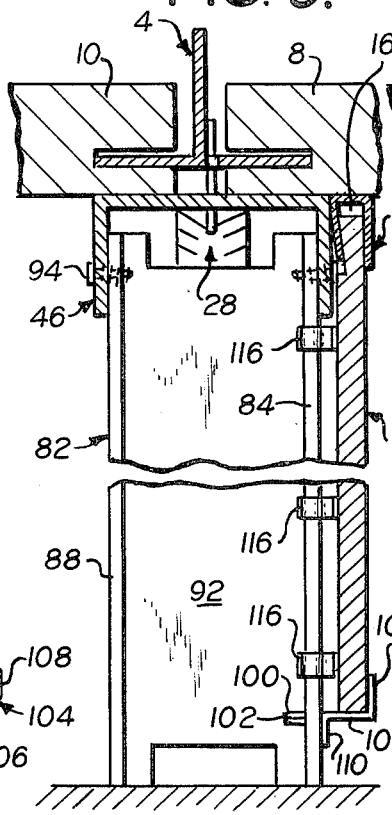
FIG. 9 is a view similar to FIG. 8 further showing the manner by which a vertical wall partition is connected to the vertical partition support and the manner by which the same rests on a partition resting device.

According to a preferred embodiment of the invention, the vertical partition supports run along the vertical support member and depends therefrom at regular intervals according to the length of partition available, e.g., 6 to 8 feet. The vertical partitions are preferably provided with partition holding means on which a partition can rest. These vertical holding means restrain the partition from downward movement. To such an end there is provided at least one slot 100 on the face of the vertical partition support at the bottom thereof. This slot can accommodate a lip 102 disposed at the end of a generally L-shaped partition resting member 104. This resting member is generally L-shaped and comprises a lower flange 106 and an exterior flange 108. There is also provided a downwardly protruding shoulder 110 which protrudes from the lower flange 106 at the lip 102. The purpose of this shoulder 110 is to bear against the exterior surface of a flange of the vertical partition as shown in FIG. 9. This shoulder 110 also restrains further entry of the flange 106 into the slot 100 thereby defining a resting surface upon which a partition 112 can rest.

Figure 12:
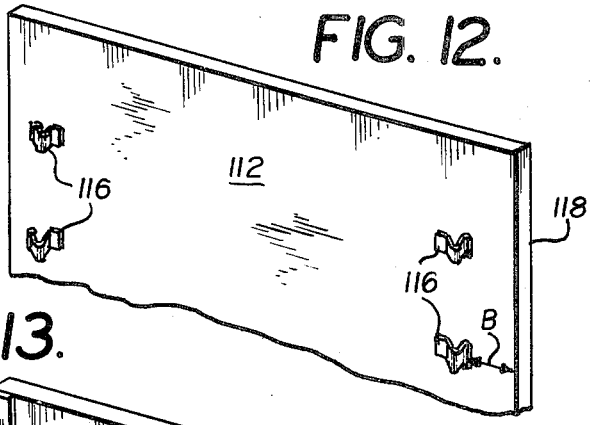
FIG. 12 shows one embodiment of a removable partition provided with cam-like snap in members which can engage a flange of a vertical partition support.

The partition is desirably one provided with partition hanger means on the back surface thereof. To such an end there can be provided clips such as shown in FIG. 12 made of a resilient material which will deform upon engagement with an edge of a flange 84–90 and deform around the same so as to lie in clamping engagement with an interior surface of one of such flanges. This is shown in FIG. 9. Here, an arcuate cam-like surface 116 bears against a flange 84. Preferably, there are a plurality of linearly disposed resilient clamp members 116 disposed vertically along the back surface of the panel 112 as shown in FIG. 12. If such an assembly is employed the clamps 116 should be set off from the edge 118 of the partition 112 a distance B to permit the partition 112 to overlie half of the face 120 (FIG. 7) of the vertical partition support 82.

Figure 13:
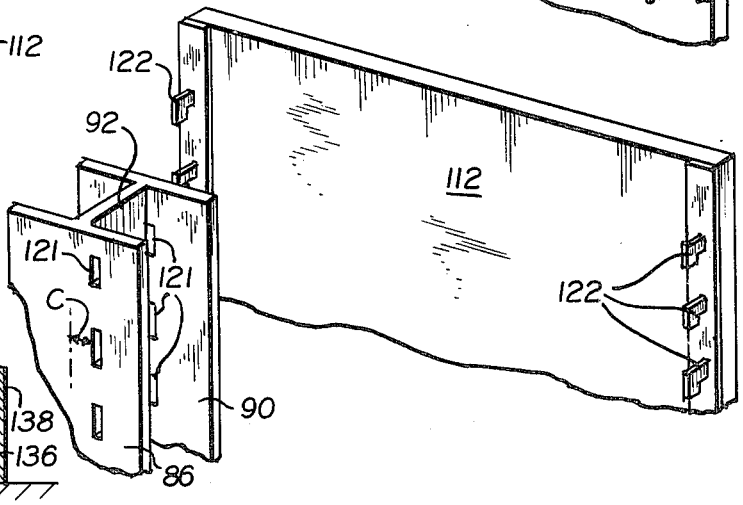
FIG. 13 shows another embodiment of a removable wall partition having downwardly facing L-shaped hanger means engagable in vertically running slots in a vertical partition support.

Another method by which the panel 112 can be connected to the vertical partition support is shown in FIG. 13. According to the embodiment therein vertically aligned slots in the form of vertically disposed rectangles 121 are disposed along the length of the flanges. In FIG. 13 there is shown the disposition of these vertically aligned rectangular slots in respect of flanges 86 and 90. These slots are engaged by downwardly facing inverted L-shaped hanger members 122. It will be observed that where the hanger members 122 are disposed at an edge 118 of panel 112 that no distance B need be provided. In this instance the slots 121 are disposed substantially centrally of the width of the vertical partition support 82. Of course, where a cross member 92 lies between the flanges on one side thereof and the flanges on the other side thereof equidistant the lateral edges of the vertical partition support 82 some provision must be made for disposing the L-shaped hanger means 122 off the edge 118 of the panel 112 inasmuch as the slots 122 cannot be in direct alignment with the cross member 92. This means that a certain lip must extend a distance C between the slots 122 and the center vertical of the vertical partition support 82. Distance C corresponds substantially with distance B (not shown on panel 112 of FIG. 13).

Figure 11:
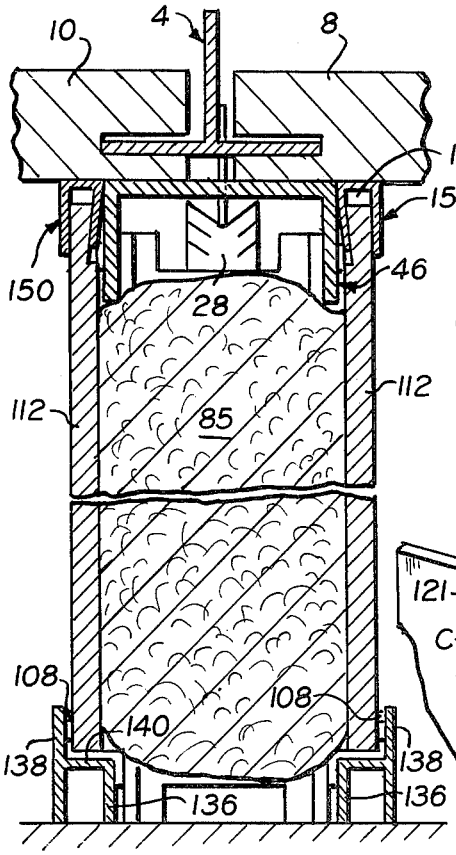
FIG. 11 is a view similar to FIG. 10 showing the opposed partion panel also in place and showing snap-in type moldings disposed beneath the partition resting members at a structural floor.

After the partition 112 has been set in place by the hanger action of the snap-in action described, the channel beneath the ledge 106 of the partition resting means can be accommodated by a snap-in molding as shown in FIG. 11. The snap-in molding is preferably made of a resilient material and can be either metallic or plastic. The snap-in molding has a generally *h* cross section comprising short leg 136 interconnected to longer leg 138 by horizontal connector 140. The longer leg 138 overlies the flange 108 as seen in FIG. 11, thus giving the wall a dressed appearance.

The advantage of the assembly lies in the fact that using a vertical support of the type described variations in structural floor level can be accommodated. It is known that structural floors in commercial buildings are never perfectly level and problems have heretofore existed in the assembly of vertical partitions, especially removable partitions. Problems were encountered in that if the vertical partition were disposed against the floor a gap would invariably occur at the top of the partition where is approached the ceiling. For this reason the use of removable partitions came into some disfavor. Instead permanent partitions were erected whereby through use of sheetrock and appropriate taping and spackeling the normal gaps could be covered. Of course, such a solution is only useful for permanent partitions.

Figure 10:
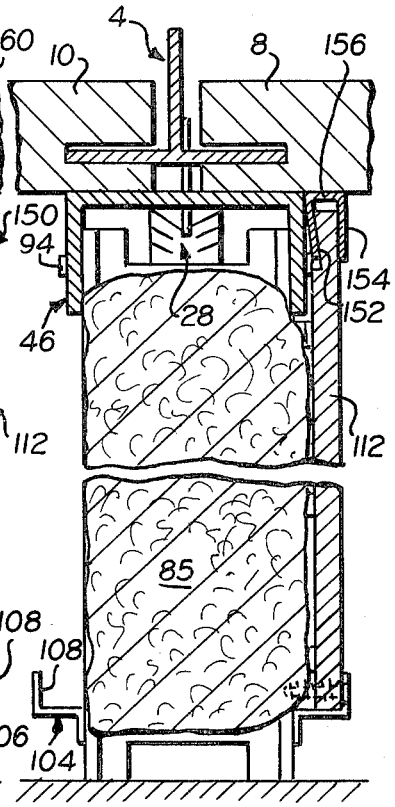
FIG. 10 is a cross sectional view similar to FIG. 9 showing the disposition within a wall of a thermal or sound insulating material.

However, according to the invention any gap due to floor uneveness which may occur at the top of the removable partition is easily obscured by use of a generally inverted U-shaped molding 150, shown in FIGS. 10 and 11. This molding can similarly be made of a metallic or plastic material and is preferably resilient. It generally consists of an inverted trough-like track having an inwardly canted inner wall 152 and a generally planar outer wall 154 shown in FIG. 1. The inner wall 152 protrudes toward the removable partition 112 as shown in FIGS. 9 and 10. The upper planar wall 156 which innerconnects the inner wall 152 with the finished wall 154 extends generally along the ceiling tile but does not protrude into the ceiling tile. The outer wall 154 descends over the top portion of removable partition 112 thereby entirely obscuring the gap 160 between the partition 112 and the ceiling tile 14. The assembly is vertically rideable over the surface of panel 112 to fill any gap.

The variation in the floor inclination is realized when one compares FIGS. 9 and 10. Whereas a gap 160 is present in the assembly of FIG. 9 the wall panel of 112 rises almost entirely to the horizontal member 156. However, when viewed from the side both walls appear the same inasmuch as the viewer cannot see gap 160.

Figure 3:
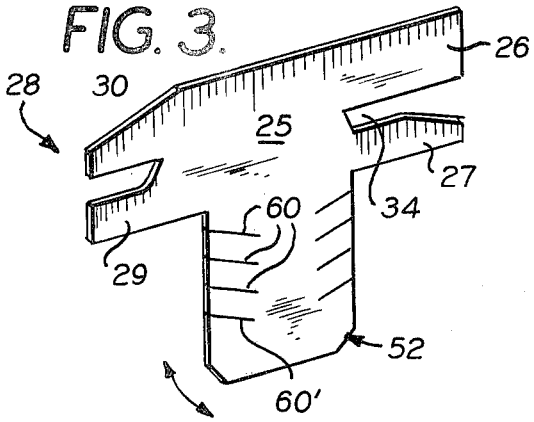
FIG. 3 is a further enlarged view of the clip of FIG. 2.

A fundamental contribution of this assembly centers about the clip of FIG. 3 described generally above. Clip 3 has two pair of arms interconnected by a vertical bridge 25. Long arm 26 rests on one side of vertical bridge 24 while shorter arm 30 rests on the other side thereof. Disposed beneath arms 26 and 30 are a second pair of arms 27 and 29. Arm 27 is longer than arm 29. It should be understood, however, that while longer arms 26 and 27 are shown to be disposed on the same side of vertical bridge 25 this need not be so. Arm 27 can be disposed beneath short upper arm 30 inasmuch as the vertical support member 46 can be assembled thereon by appropriate movement of the same with respect to arms 27 and 29. Again, arm 27 is preferably beveled so that during insertion of the clip 28 in the slot 22 of the main runner 4 no damage occurs at 31 to the ceiling tile 14.

Figure 14:
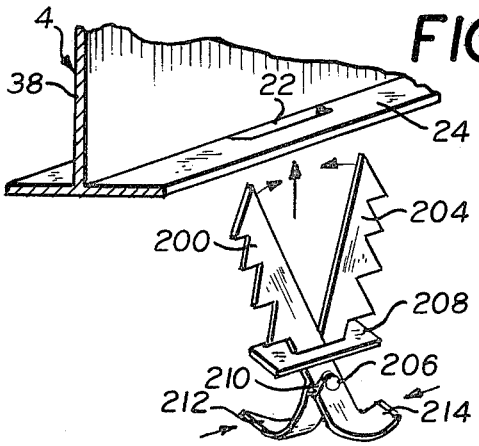
FIG. 14 shows still another embodiment of a clip to join the vertical support member to the grid assembly.
Figure 14:
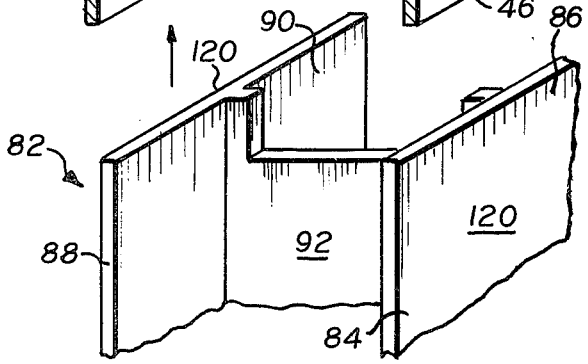

Another embodiment of a clip is shown in FIG. 14 which comprises serrated leaf blades 200 and 204 hinged at hinge 206. The device is provided with a stop plate 208. The serrated leaves 200 and 204 are biased apart by a spring 210. These leaves can be drawn together by pressure on thumb handles 212 and 214. In use, tension is applied against the thumb handles, thereby drawing the serrated leaf blades 200 and 204 together. The clip is inserted through the slot 50 of the vertical support member and thence through the slot 22 on a main runner or cross member. When the stop plate 208 abuts the bottom surface of the horizontal member 48 of the vertical support member, the tension on the handles 212 and 214 is released, thereby disposing a serrated leaf over the main runner or cross member whereby to engage the same. Obviously, the vertical support member can be removed by a scissor type action which will draw the serrated leaf blades together and allow for their vertical removal from the assembly.

The assembly of a vertical removable partition is relatively easy. Initially, the clip 28 is put in place as shown in FIG. 2 and thereafter the vertical support member 48 is secured over the arms 27 and 29 by a similar movement. Vertical support member 46 is rigidly engaged to the assembly by turning V-shaped securing members 60 or by appropriate use of a cotter pin and hole assembly as shown in FIG. 6.

Thereafter, variously spaced vertically running partition supports 82 are attached to the vertical support member which now runs along a seam between vertical ceiling tiles. This seam is shown at reference numeral 81. The vertical partition 82 is secured to the vertical support 46 by use of self-threading screws 94. A partition resting means having a coextensive lip 102 is inserted within slot 100 disposed at the lower end of the vertical partition and the partition is snapped in place as shown in FIG. 9 employing either removable partition panels of FIGS. 12 or 13. Thereafter, sound or thermal insulation material 85 is inserted within the interior of the wall and the wall is closed as shown in FIG. 11 by a mirror image assembly. A top molding 150 can be inserted in place during the attachment of the partition panel to the vertical partition support also as shown in FIG. 9. Thereafter, the floor molding is snapped in place and the job is completed.

Removal of the partition is accomplished by the reverse order. The floor molding is withdrawn and the panels 112 are removed by urging them outwardly or by raising them slightly so as to permit any downwardly facing leg to clear a slot 120. The panel together with any ceiling molding is removed. The V-shaped securing member on the clip 28 is turned once again so as to align the closure members in general alignment with the vertical bridge 25 thereby allowing for removal of the vertical support member. Once the vertical support member is removed the clip is moved in the reverse manner as described above and a slight downward urging removes the same from within the seam of the ceiling tile. This can all be done without any damage to the ceiling tile assembly.

It would obvious to a person of skill in the art that this assembly can be done without any particular skill and without damage to any of the components of the structure. Moreover, there results a completely finished appearance which does not reveal any gaps or the like. The vertical partition panels can be snapped in and out of place with relative ease. Obviously, the partition panels can be run in the direction of the main runners or in the direction of the cross members. Hence, in the construction of a suspended ceiling tile both the main runners and the cross members are slotted, preferably at the same regular intervals. This provision facilitates the insertion of the clips in the seams between adjacent ceiling tile.

Additional advantages will be obvious to one of skill in the art from the above disclosure.

What is claimed is:

1. In a suspended ceiling tile assembly wherein main runners and cross members intersect to define a grid assembly, said grid assembly having horizontal ledges engaged by ceiling tile, the improvement for attaching a vertical dependent member therefrom from a single accessible side of said ceiling tile wherein there is at least one slot in a main runner or in a cross member, a vertical support member extends from said grid assembly at said slot, said vertical support member having a generally horizontal top member having a slot therein, the slot of said generally horizontal member and the slot of said main runner or cross member being in general registry with one another and separated by a gap, said main runner or cross member being interconnected with said horizontal member of said vertical support member by a clip which overlies a horizontal ledge of a main runner or cross member and underlies said horizontal member, said clip defining the gap between said main runner or cross member and said vertical support member whereby said clip can be inserted in the space between abutting ceiling tile to engage on said main runner or cross member and said clip can hold said vertical support member against said ceiling tile at said space, said clip being removable from said main runner or cross member to remove said vertical support member from abutment against said ceiling tile.

2. A ceiling tile assembly according to claim 1 wherein said gap is substantially filled with ceiling tile.

3. A ceiling tile assembly according to claim 2 wherein said clip has a plurality of alternate securing means to regulate the size of said gap.

4. A ceiling tile assembly according to claim 2 wherein said vertical support member is in the form of a generally inverted U-shaped trough having vertical descending elements which meet said horizontal member at an angle of about 90°.

5. A suspended ceiling tile assembly according to claim 1 wherein said clip comprises a pair of generally horizontal upper arms, interconnected by a vertical bridge, to a pair of generally horizontal lower arms, one of said upper arms being longer than the other and one of said lower arms being longer than the other, said clip having engaging means vertically dependent therefrom.

6. A suspended ceiling tile assembly according to claim 5 wherein the shorter of said upper arms is beveled on its upper surface at its end.

7. A ceiling tile assembly according to claim 5 wherein the longer of said lower arms is beveled on its upper surface at the end thereof.

8. A ceiling tile assembly according to claim 5 wherein there are a plurality of alternate engaging means.

9. A ceiling tile assembly according to claim 5 wherein said engaging means comprises a generally vertical tab having at least one rotatable securing means which, when rotated, abuts the bottom surface of the horizontal member of said vertical support.

10. A ceiling tile assembly according to claim 9 wherein said engaging means comprises a plurality of vertically disposed rotatable V-shaped securing means nested one over the other whereby rotation of one of such securing means disposes the opposed end of the V thereof against the bottom side of said horizontal member.

11. A ceiling tile assembly according to claim 5 wherein said engaging means comprises a generally vertical tab having at least one hole therein through which partially passes a horizontal securing pin.

12. A ceiling tile assembly according to claim 11 wherein there are a plurality of alternately spaced holes in said tab.

13. A ceiling tile assembly according to claim 11 wherein said securing pin is a cotter pin.

14. A ceiling tile assembly according to claim 2 wherein to said vertical support member there is attached a vertically running partition support.

15. A ceiling tile assembly according to claim 14 wherein there are a plurality of vertically running partition supports spaced apart and fastened to a vertical support member, said partition supports extending from said vertical support to the floor of a structure, said partition supports having flange lips extending laterally in facing relationship toward one another.

16. A ceiling tile assembly according to claim 15 wherein disposed over said flange lip and extending from one partition support to another there is a partition panel, said partition panel springingly engaged onto said flange by a clip attached to said partition panel.

17. A ceiling tile assembly according to claim 16 wherein said vertical partition support has a pair of vertically running flanges on either side thereof interconnected by a vertical partition cross member.

18. A ceiling tile tile assembly according to claim 17 wherein said vertical partition support has an H cross section; there are a plurality of said vertical partition supports disposed along and attached to said vertical support member, the flanges on one side of said vertical support partition being interconnected with flanges on an adjacent vertical partition support by a wall partition, the flanges on the opposite side of said vertical partition support being interconnected to the opposite flanges of said adjacent vertical partition support by a wall partition thereby defining an enclosed area between wall partitions.

19. A ceiling tile assembly according to claim 18 wherein said enclosed area contains sound or thermal insulation material.

20. A ceiling tile assembly according to claim 14 wherein said vertically running partition supports extend to a structural floor therebeneath, said vertically running partition supports each carrying externally thereof a partition resting means.

21. A ceiling tile assembly according to claim 20 wherein said vertically running partition has at least one receiving means therein, said receiving means carrying a removable partition resting means.

22. A ceiling tile assembly according to claim 21 wherein said receiving means comprises a slot in said vertical partition support.

23. A ceiling tile assembly according to claim 22 wherein said partition resting means comprises a generally L-shaped member having a protruding coextensive lip which fits within said slot and a pendent shoulder, pendent from a leg of said L at said lip to restrain further insertion of said lip into said slot and to engage the external surface of said vertical partition support.

24. A ceiling tile assembly according to claim 20 wherein a partition rests in said partition resting means and defines a channel beneath said partition and above the floor of a structure.

25. A ceiling tile assembly according to claim 24 wherein disposed within said channel and over a portion of said resting means, there is a generally h-shaped resilient snap-in molding, the legs of which extend toward the floor.

26. A ceiling tile assembly according to claim 14 wherein to a pair of linearly spaced apart vertically running partition supports there is attached a partition panel, which partition panel extends toward the floor of a structure leaving a ceiling gap at the top thereof between said ceiling tile and the top of said partition and a molding disposed over said ceiling gap and said partition.

27. A ceiling tile assembly according to claim 26 wherein said molding has a generally inverted U-shaped, said vertical partition support has a laterally extending flange, one leg of said inverted U-shaped molding engaging said flange at the top thereof.

28. A ceiling tile assembly according to claim 15 wherein said flange lips of said vertical partition support have vertically running partition receiving slots therein, a partition is attached to said vertical partition support, said partition having generally vertically and linearly disposed inverted L-shaped hangers, the legs of said inverted L-shaped hangers engaged within a partition receiving slot on said flange lip.

29. A suspended ceiling tile assembly according to claim 1 wherein said clip comprises a pair of serrated leaf blades facing one another interconnected at a hinge and biased apart from one another by a spring, said clip having a stop plate at said hinge adaptable to abut a surface.

* * * * *